United States Patent [19]

Seifried

[11] 3,943,821

[45] Mar. 16, 1976

[54] CARTRIDGE CHAMBER FOR AUTOMATIC FIREARM

[75] Inventor: Paul Seifried, Badenweiler, Germany

[73] Assignee: Rheinmetall GmbH, Germany

[22] Filed: July 2, 1973

[21] Appl. No.: 375,839

[30] Foreign Application Priority Data

July 4, 1972 Germany ..... 2232679

[52] U.S. Cl. ..... 89/16

[51] Int. Cl.[2] ..... F41F 17/06

[58] Field of Search ..... 42/76, 78; 89/14, 16

[56] References Cited

UNITED STATES PATENTS

| | | | |
|---|---|---|---|
| 1,163,450 | 12/1915 | Pervelis | 89/16 |
| 1,355,422 | 10/1920 | Pedersen | 42/78 |
| 2,992,596 | 7/1961 | Hammer | 89/16 |

FOREIGN PATENTS OR APPLICATIONS

| | | | |
|---|---|---|---|
| 605,136 | 7/1948 | United Kingdom | 42/76 R |

*Primary Examiner*—Stephen C. Bentley

*Attorney, Agent, or Firm*—Williamson, Bains & Moore

[57] ABSTRACT

In an automatic firearm, the cartridge chamber at the barrel end is assembled of two elements and the interface between them is gas pressure sealed. Each element has a different number of gas pressure balance grooves leaving a minimum of support surface for the cartridge with resulting minimum of resistance against pulling of the empty cartridge.

4 Claims, 3 Drawing Figures

CARTRIDGE CHAMBER FOR AUTOMATIC FIREARM

BACKGROUND OF THE INVENTION

The invention is concerned with an automatic firearm and in particular relates to the cartridge chamber of such firearms which have an intensified inertia breech mechanism and, in the cartridge chamber, are provived with a conical transition between bullet chamber and powder chamber, said transition portion serving as a stop means for the cartridge.

In all types of automatic firearms, gas pressure balance grooves permit an increase of the fire cadence and simultaneously the operation of the weapon will become substantially independent of the material quality of the cartridge, and dirty ammunition will not interfere with the firearm function.

In any case the number of such grooves and the length and width thereof will determine the abutment surface which remains in the cartridge chamber and on which the cartridge will be supported during the gas pressure development. Once the bullet has left the cartridge, a pressure balance will occur via said grooves. The bonding of the cartridge at the support surfaces and the finish of the latter determine the slide resistance of the cartridge in the weapon chamber, and this applies in particular to firearms having an intensified inertia breech mechanism.

For ammunition having a shoulder and cartridge neck, the possible maximum number of gas pressure balance grooves is, in known firearms, dependent upon the minimum diameter of the cartridge chamber which is here and in the following referred to as "bullet chamber."

BRIEF SUMMARY OF THE INVENTION

It is the object of the present invention to improve such known automatic firearms with respect to reducing the slide resistance of the cartridge in the cartridge chamber in order to increase further the fire cadence thereby retaining the independency of cartridge material quality and cleanness.

The invention consists in that the cartridge chamber portion containing the powder chamber is formed by a tubular member mounted at the barrel and urged thereagainst, and that said tubular member is provided with gas pressure balance grooves exceeding in number those provided in the bullet chamber of the barrel. Due to the increased number of gas pressure balance grooves within the powder portion of the cartridge chamber, the surfaces which support the cartridge are, in their entirety, reduced and thus the slide resistance of the cartridge is substantially decreased.

In order to distribute the powder gases which leave the gas pressure balance grooves in the bullet chamber, equally to the greater number of grooves in the said tubular member it is preferred to provide the opposing faces of the weapon barrel and of the tubular member with inner shoulders or steps which, when abutting each other, confine an annular groove which opens to the chamber interior and receives a metallic sealing ring while simultaneously forming an annular gas distribution space. By chamfering the opposing end faces between the grooves of barrel and tubular member, said annular space may be increased in section and becomes conical in shape.

Preferably, the firearm barrel and the tubular member have guide cylinders provided with oppositely oriented screw threads permitting the urging of the elements against each other in a gas-tight manner within a tubular extension of a part of the breech mechanism.

The invention, features and advantages thereof will become fully apparent when reading the following detailed description of a preferred embodiment illustrated in the accompanying drawings.

DESCRIPTION OF THE PREFERRED EMBODIMENT

Figure 1:
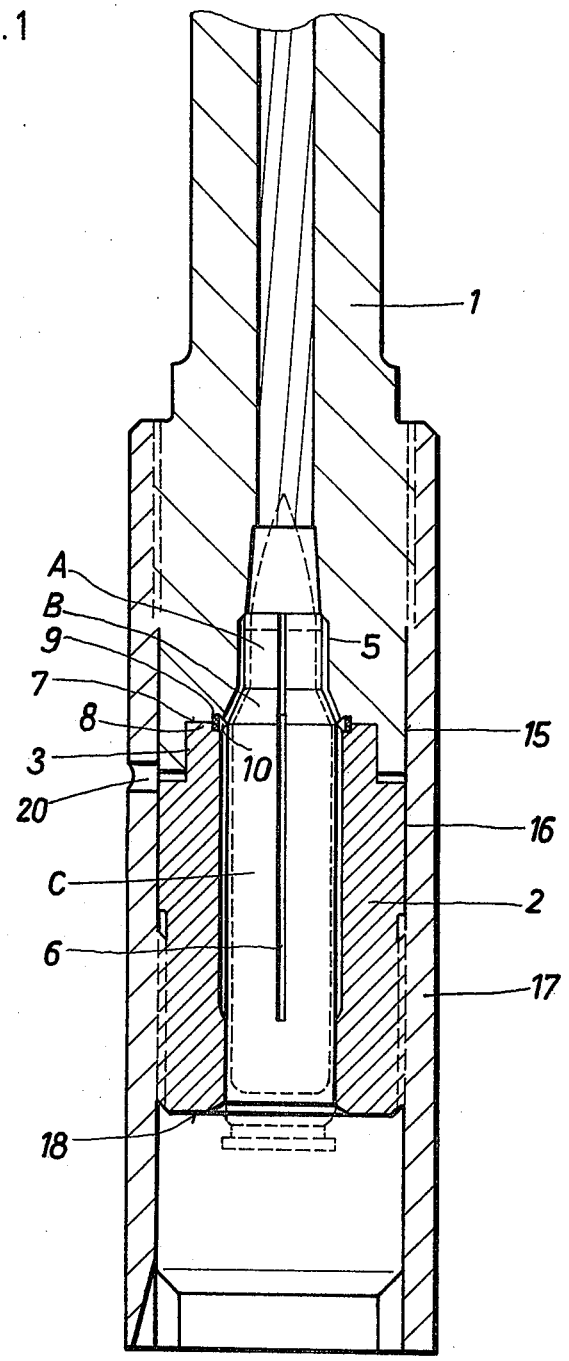
FIG. 1 is an axial section view of that portion of an automatic firearm which has been designed in accordance with the teachings of the invention.
Figure 2:
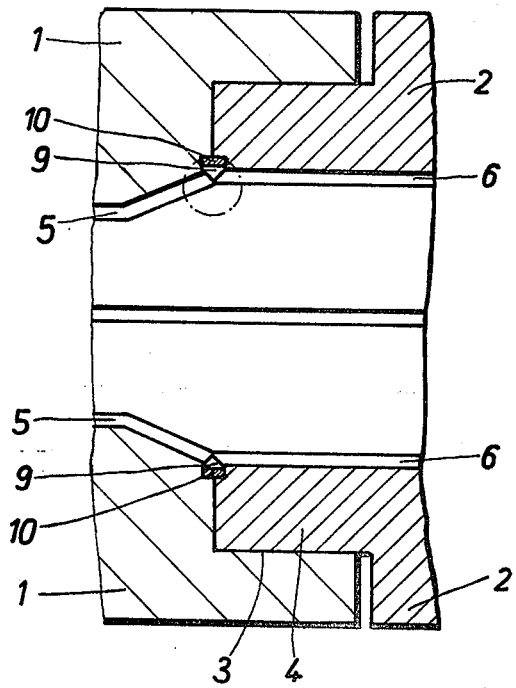
FIG. 2 shows in enlarged scale a detail of FIG. 1.

As shown in FIG. 1, a tubular member 2 containing the powder chamber C is mounted at the gun barrel 1 which is provided with the bullet chamber A and the transitional cone B. Barrel 1 and member 2 engage each other by means of a coupling bore 3 at the barrel end and a mating coupling collar 4 of reduced diameter on the facing end of member 2. Within bullet chamber A and transitional cone B, the barrel is provided with pressure balance grooves 5, the number of these grooves being determined by the relatively small diameter of the bullet chamber A. Due to the relatively greater diameter of the powder chamber C, the tubular member 2 may be provided with a substantially greater number of pressure balance grooves 6. The increased number of such grooves 6 in member 2 permits substantially reducing the slide and bond resistance of the cartridge.

Figure 3:
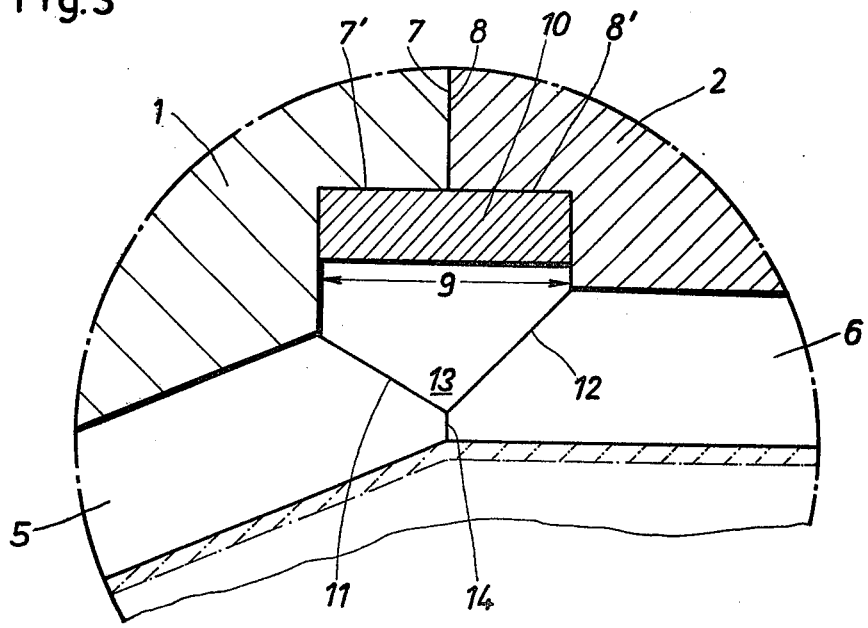
FIG. 3 shows in a further enlarged scale the detail encircled in FIG. 2.

Barrel 1 and tubular member 2 have shoulders 7′, 8′ machined in the abutting faces 7 and 8, respectively, said shoulders confining together an interiorly open annular groove 9 which receives a cylindrical metallic ring 10 and defines an annular space for equally distributing the powder gases emanating from the pressure balance grooves 5 of the bullet chamber to the pressure balance grooves 6 in the tubular member 2. The cylindrical metal ring, because of its small wall thickness, will be axially deformed upon urging barrel 1 and member 2 against each other so that penetration of powder gases between the faces 7, 8 will be prevented. The annular space remaining in the annular groove 9 provides a gas communication path from the pressure balance grooves 5 of barrel 1 to the pressure balance grooves 6 in tubular member 2. As shown in FIG. 3, the abutting ends of barrel 1 and member 2 facing each other may be provided with chamfers 11 and 12, respectively in order to increase the annular space so that it assumes the shape of a distribution cone 13. The chamfering preferably is designed such that both members 1, 2 retain an inner annular abutment rim 14.

Barrel 1 and tubular member 2 are provided with guiding cylinders 15 and 16, respectively, slidingly received within a tubular extension 17 of the locking member. By means of right-hand threads for barrel 1 and left-hand threads for member 2, both elements are urged against each other within said tubular extension. Tubular member 2 will be positioned with its rear face 18 spaced a desired distance from the locking surface (not shown) of the locking member.

By screwing the elements 1, 2 against each other, they will be connected in a gas tight manner due to the sealing ring 10.

Barrel 1 may be press-fitted in an axial direction into the tubular extension 17 of the locking member in case the barrel and locking member are machined for provision of a press fit. In order to check the gas tight sealing, tubular extension 17 has a vent bore 20.

What I claim is:

1. In an automatic firearm having a breech mechanism, with a cartrige chamber having a bullet chamber portion formed in the inner end of the barrel and a powder chamber portion adjacent thereto, and a conical transition portion therebetween serving as a stop for the cartridge, said transition portion being provided with gas pressure balance grooves, the improvement comprising:

a tubular member forming said powder chamber portion mounted adjacent to the inner end of the barrel of said firearm and bearing thereagainst;

a plurality of gas pressure balance grooves in said bullet chamber portion extending longitudinally thereof;

a plurality of pressure balance grooves in said tubular;

opposing inner shoulders on the respective opposing ends of the inner end of said barrel and of said tubular member, said shoulders defining together and forming an interiorally open annular groove; and a cylindrical sealing ring seated within said annular groove against the outside circular wall surface thereof in outwardly spaced relation from the inner longitudinal surfaces of the inner end of said gun barrel and the adjacent end of said tubular member to thereby provide an annular space for the distribution of powder gasses flowing from said pressure balance grooves in said bullet chamber portion to said pressure balance grooves in said tubular member.

2. A firearm as defined in claim 1 wherein:

the opposed ends of said barrel and said tubular member abut and are chamfered to thereby give a generally conical shape in transverse cross section to said annular space between the opposed, facing ends of said gas pressure balance grooves in said bullet chamber and said tubular member to thereby serve as a powder gas distribution chamber therebetween.

3. A firearm as defined in claim 1 wherein:

the adjacent ends of said barrel and said tubular member each have cylindrical guide surfaces formed on the outer periphery thereof fitted into a tubular extension of a breech mechanism member, and adapted to be urged against each other.

4. A firearm as defined in claim 3 wherein:

oppositely oriented threads are formed on said cylindrical guide surfaces of said barrel, said tubular member and said tubular extension to permit urging of said barrel and said tubular member against each other by means of a screwing motion within said tubular extension.

* * * * *

UNITED STATES PATENT OFFICE

CERTIFICATE OF CORRECTION

Patent No. 3,943,821 Dated March 16, 1976

Inventor(s) Paul Seifried

It is certified that error appears in the above-identified patent and that said Letters Patent are hereby corrected as shown below:

In claim 1, line 25, delete semicolon after "tubular" and add "member extending longitudinally thereof;"

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*